United States Patent [19]

Hallett et al.

[11] 4,146,225

[45] Mar. 27, 1979

[54] PADDLE BALL GAME

[76] Inventors: Earl H. Hallett; Wayne K. Hallett, both of 180 Birch St., Bangor, Me. 04401

[21] Appl. No.: 753,597

[22] Filed: Dec. 22, 1976

[51] Int. Cl.[2] ..... A63B 71/04

[52] U.S. Cl. ..... 273/95 R; 273/30

[58] Field of Search ..... 273/95 R, 95 G, 95 H, 273/96 R, 97 R, 98, 30, 29 R; 272/3

[56] References Cited

U.S. PATENT DOCUMENTS

| | | | |
|---|---|---|---|
| 454,700 | 6/1891 | Barker | 273/30 X |
| 2,163,456 | 6/1939 | Youngberg | 273/95 R |
| 2,275,179 | 3/1942 | Heil | 273/30 |
| 3,872,623 | 3/1975 | Spaulding | 273/95 H X |
| 4,030,734 | 6/1977 | Castellucci | 273/30 |

*Primary Examiner*—William H. Grieb

*Attorney, Agent, or Firm*—David Francis Gould

[57] ABSTRACT

A game having two playing surfaces one suspended above the other. A ball or other missile is bounced off one surface so that it hits the second surface. One or both surfaces may be irregular to impart random bounces to the ball or missile.

1 Claim, 4 Drawing Figures

Fig. 2.
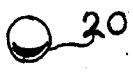
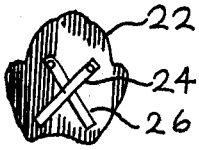
Fig. 3.
Fig. 4.
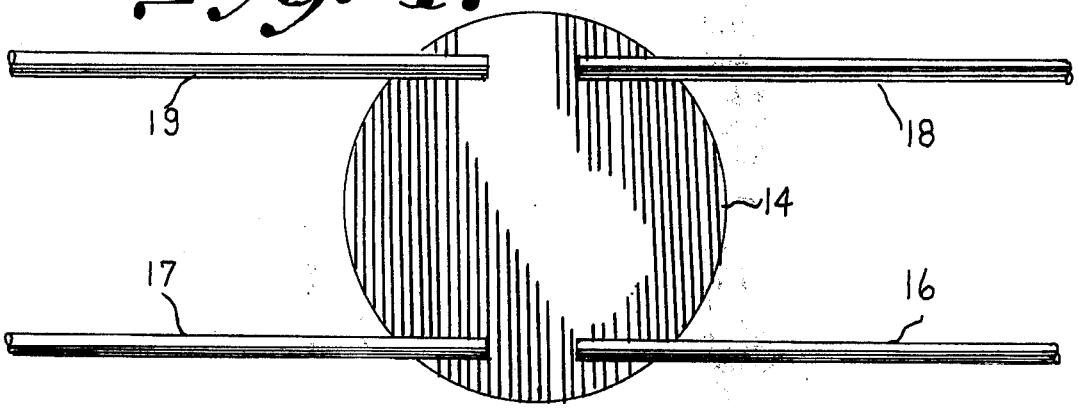

PADDLE BALL GAME

BACKGROUND

1. Field of the Invention

Our invention relates to the field of table ball games. In particular, our invention is in the field of paddle ball games whereby one or more players bounce a ball or other missile with paddles. The principle of the invention is to use two spaced apart substantially coplanar surfaces with the ball or other missile being bounced between the surfaces.

2. The Prior Art

Table ball games such as table tennis have been used for many years. In general, they employ a large rectangular table bisected by a low net. The object in this type of game is to hit the ball with a hand held paddle so that the ball returns to the other side of the table beyond the net. One disadvantage of table tennis is that it requires a relatively large rectangular table which occupies much floor space and is difficult to store or disassemble when the game is not in use. Another disadvantage is that considerable skill is required to return the ball to your opponent in such a manner that is difficult for him to hit it back to you. Further, in table tennis there is little opportunity for exercise because it is possible to cover your end of the table with a minimum of body movement.

SUMMARY OF THE INVENTION

Our invention is a solution to the problem of how to have a compact table ball game that provides a good opportunity for physical exercise.

Two spaced apart surfaces are provided. The lower surface may be in the form of a table. This table may be circular for ease of player movement about the table. The upper surface may be the ceiling of the room or it may be a suspended surface such as a circular disc the approximate size of the lower table. If the upper surface is a suspended circular disc, it may be made transparent or translucent so as not to cast a strong shadow or interfere with room lighting. Either or both of the spaced apart surfaces may be a surface that is not perfectly flat. The purpose of the departing from a flat surface is to impart random bounces to the missile that is hit between the spaced apart playing surfaces. This adds more movement to the game. For example, the lower surface or table may have a conical surface which makes the center of the lower table slightly higher than the outer edges.

A resilient missile such as a ball may be bounced with the bare hands between the upper and lower playing surfaces. Alternatively, a hard missile or ball may be used and a resilient surface may be provided on one or more of the spaced apart playing surfaces. Paddles with either hard surfaces or resilient surfaces may be used to bounce a ball or other missile between the upper and lower playing surfaces.

DESCRIPTION OF DRAWINGS

FIG. 2 is an elevation of a ball suitable for use in our invention.

FIG. 3 is an elevation of the back of a hand paddle which may be employed in the present invention.

FIG. 4 is a top plan view of an upper playing surface illustrating a suspension means.

DESCRIPTION OF PREFERRED EMBODIMENT

Figure 1:
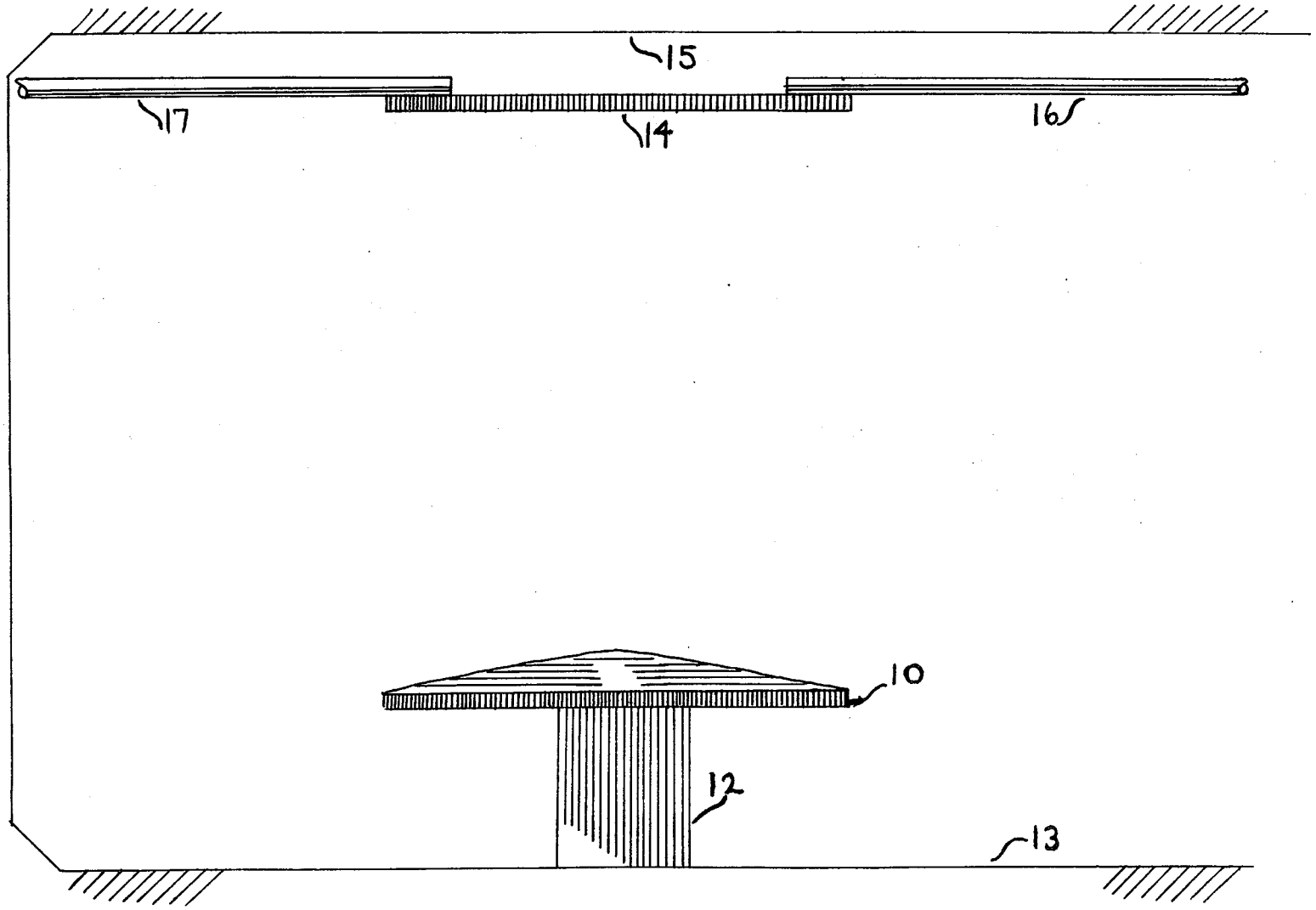
FIG. 1 is an elevation view of our paddle ball game in the playing position.

As shown in FIGS. 1 & 4, a first playing surface or table 10 having a slightly conical surface is provided mounted on pedestal 12 at a convenient distance above the floor 13. A second playing surface or table 14 is mounted above the first playing surface by means of support members or pipes 16, 17, 18 and 19. The pipes are horizontal rather than vertical to keep the area around the first playing surface 10 clear of obstructions so that the players have free movement about the first playing surface 10. Alternatively, the upper playing surface 14 may be dispensed with if the ceiling 15 is at a suitable height above the first playing surface 10. If the ceiling is used as the upper playing surface, it is desirable to provide an out of bounds circle on the ceiling 15 to add interest to the game. Both lower playing surface 10 and the upper playing surface 14 are circular and of substantially the same size. The round shape of the lower playing surface or table 10 enable free player movement around the table 10 to bounce the ball 20 of FIG. 2 in a manner that will be described later. It is not necessary for the upper playing surface 14 to be the same size as the lower playing surface 10. Nor it is necessary for the upper playing surface or table 14 to be the same shape as the lower playing surface or table 10. The upper playing surface 14 may be conical in shape or have portions angled with respect to the lower playing surface 10. It is convenient to have the ball 20 made of resilient material and structure. However, either or both of the playing surfaces could be made resilient and a hard ball used. The upper playing surface support members 16, 17, 18 and 19 may be attached to walls (not shown) if the game is used indoor. Should the game be used outdoors, the support members 16, 17, 18 and 19 for the upper playing surface 14 may be attached vertical upright (not shown) provided that the vertical supports are far enough away from the bottom table 10 so that they do not interfere with player movement.

In FIG. 3 is shown a hand paddle 22 adapted to be mounted on the player's hand by means of straps 24 and 26. Alternatively, a table tennis paddle with a handle can be used.

OPERATION

In operation we prefer to play the game as follows, a player takes the ball 20 and serves by tossing it with his hand against the upper playing surface 14. The ball 20 then rebounds to the lower playing table 10 where it hits the conical surface of table 10 which imparts a second rebound to the ball 20. This rebound is random in nature due to the conical surface irregularity of lower surface playing table 10. The ball 20 is then in the air and may be struck with the paddle 22 against the upper playing surface 14 to continue the game. The ball will be kept in play by the players taking turns returning the ball until a player fails to hit it on the rebound, the rebound off the lower table goes to a zone which cannot be reached by the other player, or a player at his turn hits the ball so that the ball misses either table.

It will be apparent that there has been disclosed a paddle ball game which provides a compact, fast and vigorous game that calls for quick player movements about the table.

It will be noted that the round shape of the lower table 10 enables players to move quickly around the table ao that they can get in position to keep the ball 20 in play.

The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents may be resorted falling within the scope of the invention as claimed.

We claim:

1. A table ball game apparatus comprising:

missile means;

paddle means;

a first horizontal playing surface in the form of a table; said table having at least one conical surface irregularity to allow the missile means to bounce randomly when set in motion by the paddle means; said conical surface irregularity having its apex pointed upwardly; said table being substantially circular to allow for rapid player movement above the table;

a second horizontal playing surface spaced vertically above the table to allow the missile means to be bounced between the two playing surfaces by the paddle means.

* * * * *